US008695259B2

(12) United States Patent
Bailey

(10) Patent No.: US 8,695,259 B2
(45) Date of Patent: Apr. 15, 2014

(54) SOUVENIR AND METHOD OF DISPLAYING A RELIC

(76) Inventor: Paul Bailey, Sydney (AU)

( * ) Notice: Subject to any disclaimer, the term of this patent is extended or adjusted under 35 U.S.C. 154(b) by 0 days.

(21) Appl. No.: 13/605,177

(22) Filed: Sep. 6, 2012

(65) Prior Publication Data

US 2013/0067786 A1 Mar. 21, 2013

(51) Int. Cl.
*A47G 1/12* (2006.01)

(52) U.S. Cl.
USPC ..... 40/800; 206/457; 446/73; 446/93

(58) Field of Classification Search
USPC ..... 40/431, 800, 124.01, 124.14, 538, 554; 206/457, 45.28, 774, 6.1; 229/116.1, 229/116.4; 220/23.87
See application file for complete search history.

(56) References Cited

U.S. PATENT DOCUMENTS

| | | | | | |
|---|---|---|---|---|---|
| 193,460 | A * | 7/1877 | Reed | 446/93 |
| 2,433,540 | A * | 12/1947 | Wright | 446/73 |
| D149,184 | S * | 4/1948 | Jolley | D9/677 |
| 3,817,371 | A * | 6/1974 | Gatter | 206/0.5 |
| 4,753,346 | A * | 6/1988 | Tsuji | 206/371 |
| 4,964,831 | A * | 10/1990 | Wolff | 446/75 |
| 5,224,894 | A * | 7/1993 | Nelson et al. | 446/73 |
| 5,394,989 | A * | 3/1995 | Delson | 206/457 |
| 5,441,149 | A * | 8/1995 | Willard et al. | 206/214 |
| 6,041,918 | A * | 3/2000 | Moore | 206/0.815 |
| 6,186,349 | B1 * | 2/2001 | Tempongko | 220/4.22 |
| 6,237,788 | B1 * | 5/2001 | Shuen | 215/12.1 |
| 6,283,819 | B1 * | 9/2001 | Polinger et al. | 446/478 |
| 6,422,388 | B1 * | 7/2002 | McCahey | 206/457 |
| 6,544,097 | B1 * | 4/2003 | Bain | 446/297 |
| 6,568,532 | B1 * | 5/2003 | Leach | 206/457 |
| 6,840,380 | B1 * | 1/2005 | Gambale | 206/575 |
| 2002/0139708 | A1 * | 10/2002 | Lien | 206/534 |
| 2003/0234204 | A1 * | 12/2003 | Lam et al. | 206/540 |
| 2005/0011792 | A1 * | 1/2005 | Scott | 206/457 |
| 2006/0254945 | A1 * | 11/2006 | Green et al. | 206/457 |
| 2007/0151886 | A1 * | 7/2007 | Dewey | 206/457 |
| 2007/0193909 | A1 * | 8/2007 | Chin et al. | 206/457 |
| 2012/0024737 | A1 * | 2/2012 | Rodriguez | 206/457 |
| 2012/0285856 | A1 * | 11/2012 | Mather | 206/457 |

* cited by examiner

*Primary Examiner* — Shin Kim
(74) *Attorney, Agent, or Firm* — William J. Sapone; Ware Fressola Maguire & Barber LLP

(57) ABSTRACT

A souvenir 10 has a display portion 21 upon which is incorporated a three dimensional profile of a representation or display 40 of a memory evokable element, such as an iconic geographical location, cityscape, building, event, structure or person in positive or male profile. A complementary removable covering portion 20 has incorporated therein a negative or female profile of the representation or display 40, allowing the souvenir to be cast from either one of the portions 20, 21 should one of the portions become lost. A recess 51 is located within the display portion 21 for retaining a relic 52 taken from or closely associated with the memory evokable element displayed on the display portion 21. When assembled, the two portions show on the sides silhouettes of the representation or display, to further evoke viewer memories.

18 Claims, 8 Drawing Sheets

SOUVENIR AND METHOD OF DISPLAYING A RELIC

FIELD OF THE INVENTION

The invention relates to souvenirs and methods of displaying souvenirs, mementos and relics.

BACKGROUND OF THE INVENTION

The use of mementos, souvenirs or keepsakes to remind a user of a memory evokable element, herein defined as any person, event, place, structure, location, or occasion, among others, such as sites visited or which are in some way important to them, is well known and there are many examples of souvenirs available. While souvenirs can generally be considered to be any object a person acquires for the memories associated with it, most souvenirs are mass-produced items, such as postcards, magnets, miniature figures, etc.

The international market for the manufacture, distribution and merchandising of souvenirs and mementos is large and has a turnover of millions if not billions of dollars each year.

Many souvenirs are typically fashioned from relatively inexpensive materials and may be considered by many to be disposable items with a short effective usable lifespan. Souvenirs made out of such materials are prone to breakage or loss.

The use of geometric shapes as promotional figures and souvenirs is known. However, it represents a significant challenge to produce a souvenir which is not only aesthetically pleasing but is also relatively cost effective to manufacture, is resilient against loss or damage and which also enhances the faculties of recollection of the user by providing additional, contextual information about the iconic geographical location, building, set of buildings, event or person to be recalled.

It would be advantageous therefore to provide a new and more effective manner of providing a souvenir which in addition can be used for representing or displaying a relic associated with a memory evokable element, such as an iconic location, building, event, person, etc., in order that more information relating to the element can be incorporated into the souvenir and so be communicated to the user when he or she uses the souvenir to recall the element, whether an iconic location, building, event or person.

It would also be advantageous to provide a method of enhancing the effective usable lifespan of a memento or souvenir.

It would also be advantageous to provide a souvenir which had features which would better accentuate or enhance the faculties of recollection of the user by providing additional contextual information about the memory evokable element to be recalled.

Ideally, the souvenir should be manufactured of sturdy resilient material, and should protect the souvenir from damage.

It would be also advantageous to provide an improved method of presenting a souvenir or memento which was stackable whilst retaining its aesthetic integrity.

It would be also advantageous to provide an improved method of presenting a souvenir or memento which enabled a plurality of souvenirs collected over the course of a lifetime to be displayed simultaneously whilst retaining the aesthetic integrity of each discreet souvenir.

SUMMARY OF THE INVENTION

It is an object of the present invention to provide an improved memento or souvenir.

It is another object of the present invention to provide a memento or souvenir that will enhance the ability of the user to recall the memory associated with a memory evokable element, such as the person, place, structure, event, etc., which it represents.

It is another object of the invention to provide an improved method of presentation of a souvenir or memento which is aesthetically pleasing.

It is another preferred but inessential object of the invention to provide an improved method of presentation or display of a relic incorporated with the souvenir.

It is another object of the invention to provide an improved method of displaying a relic incorporated with a souvenir which overcomes at least some of the problems of the prior art.

It is yet another object of the invention that the souvenir be capable of being reproduced or replicated easily in the case that a portion of it is damaged or lost.

It is a further object of the present invention to provide an improved method of presentation of a souvenir or memento using stackable object portions.

Preferably, the souvenir should also be relatively cost effective to manufacture.

These and other objects of the present invention are achieved by a souvenir comprising:

a display portion upon which is incorporated a three dimensional profile that is a representation or display associated with a memory evokable element which can be selected from, but is not limited to, the group consisting of an iconic geographical location, a cityscape, a building, an event or occasion, a monument, a sculpture, a person, etc., the profile being a positive or male profile;

a removable covering portion having a complimentary three dimensional negative or female profile of the representation or display, the covering portion adapted to be placed over the display portion; and, a recess located within the display portion for retaining a relic taken from or closely associated with the memory evokable element, the recess permitting display of the relic residing therein with the representation or display.

In some preferred embodiments of the invention, the covering portion can have a plurality of protrusions located upon an external surface to allow for the stacking of the display portion upon the covering portion for the purpose of displaying the relic, the covering portion then acting as a base for supporting the display portion.

In other alternative embodiments of the invention, the protrusions may be secured within a plurality of complementary depressions located upon a bottom surface of the display portion so as to limit the independent movement of the portions when the display portion is stacked on top of the covering portion.

In other alternative embodiments of the invention, the protrusions and depressions of the covering and display portions are located so that the two portions appear to be a single unit when stacked.

There is also provided a method of displaying a relic comprising providing a souvenir having a display portion, incorporating a three dimensional profile on an upper surface of the display portion, the representation or display being associated with a memory evokable element which can be selected from, but is not limited to, the group consisting of an iconic geographical location, a cityscape, a building, an event or occasion, a monument, a sculpture, a person, etc., the profile being a positive or male profile;

providing a removable covering portion, incorporating a complimentary negative or female profile of the representation or display, the covering portion adapted to be placed over the three dimensional profile of the display portion;

providing a recess within the display portion, the recess adapted to retain a relic taken from or closely associated with the memory evokable element;

placing a relic in the recess of the display portion, and, placing the covering portion over the display portion for forming the souvenir.

The method may optionally also include the steps of:

(i) separating the covering portion from the display portion;

(ii) stacking the display portion upon the covering portion such that the covering portion provides a base for the display portion;

(iii) stacking or arranging at least one more pair of display and covering portions in an aesthetically pleasing configuration so as enable the simultaneous viewing of two or more profiles which can be complimentary representations or displays of the memory evokable element, such as an iconic geographical location, cityscape, building, event, structure or person which are the subjects of each souvenir.

BEST MODE AND OTHER EMBODIMENTS OF THE INVENTION

Figure 1:
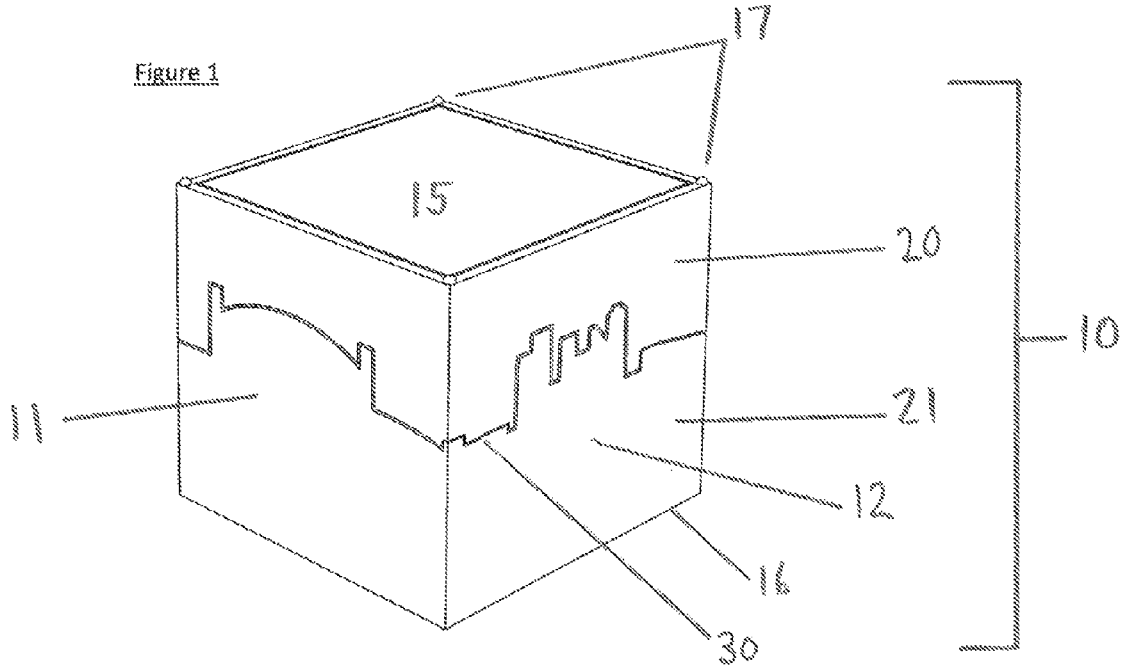
FIG. 1 is an isometric view of two surfaces of a preferred embodiment of the invention.

The present invention is an improved souvenir and method of displaying a souvenir or relic.

The souvenir can be manufactured of any suitable material such as metals, plastics, compressed natural fibres or rock. Crystal for example provides a fine material in which to fashion the souvenir however any material that can be moulded into a resilient shape may be suitable for use.

Depending upon the material used, the relic to be incorporated within the souvenir can be manufactured using laser cutting, high pressure water or sand cutting, while the souvenir or memento can be cast from a die or made by injection moulding for example. Also, the invention allows the souvenir or memento to be cast from either one of the original components should one of the components become lost. Those skilled in the art will recognise that other methods of manufacture are possible without departing from the scope of invention.

The souvenir may be any three dimensional form which can be cut or separated into at least two complementary portions so as to provide a three dimensional profile where the two portions meet. The souvenir may be for example a cube, sphere, rectangular prism, or any three dimensional form. In one preferred embodiment, illustrated in FIG. 1, the souvenir is a cube separated into two segments or portions, which is a preferred embodiment which shall be described herein as a "geo-cube" for the sake of ease of reference. However, it is to be understood that the use of that term does not in any way limit the scope of the invention to a souvenir, that when the portions are assembled, is in the shape of a cube only and many other three dimensional shapes are contemplated within the scope of the invention.

The geo-cube 10 of the preferred embodiment is cut or separated into complementary lower male and upper female portions. The profile of the lower male portion 21 is predominantly convex whereas the profile of the upper female portion 20 is predominantly concave. A cut 30 made through the geo-cube 10 forms each of the portions 20, 21. When placed together along the cut 30, portions 20 and 21 seal to form a three dimensional solid 10.

In the preferred embodiment the geo-cube has a top surface 15 and bottom surface 16 and four sides 11, 12, 13 and 14. Each adjacent side displays a contour of a part of the memory evokable element, such as an iconic geographical location, building, set of buildings, event, or person, in this case, Sydney Harbour. While internally, as will be discussed further below, there exists a three dimensional profile of Sydney Harbour, on each side, a silhouette is visible, to enhance the utilization of the geo-cube as a souvenir.

Figure 2:
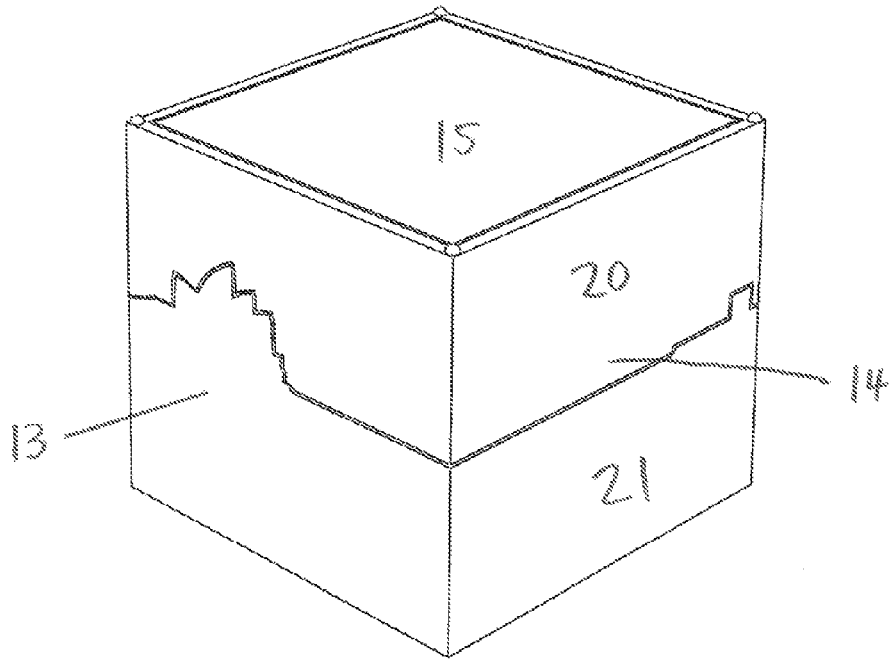
FIG. 2 is a further isometric view of the rear aspect of the preferred embodiment of the invention set out in FIG. 2.

Cut 30 defines the side viewed outlines of the three dimensional profile of an iconic geographical location, Sydney Harbour. The portion of the cut 30 shown in FIG. 1 is readily identifiable as an impression of the contours of the Sydney Harbour Bridge on side surface 11 whereas the portion of the cut 30 on the adjacent side 12 is identifiable as the Sydney city skyline. On another side 13 of the cube, shown in FIG. 2, the iconic and recognisable contours and shape of the Sydney Opera House are indicated by the portion of the cut separating the two portions of the souvenir.

Figure 3:
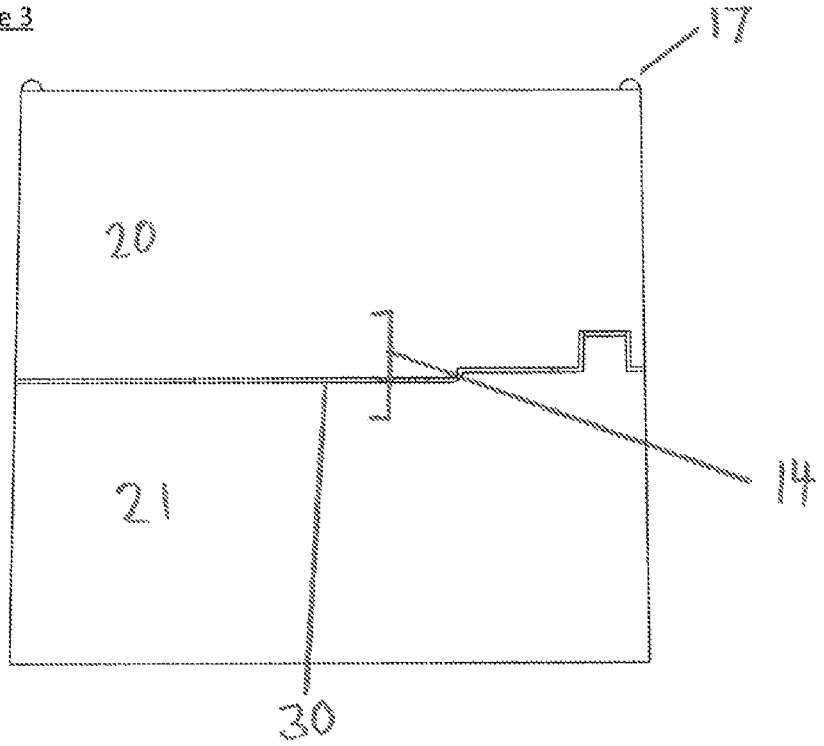
FIG. 3 is a front view of one side of the preferred embodiment.
Figure 4:
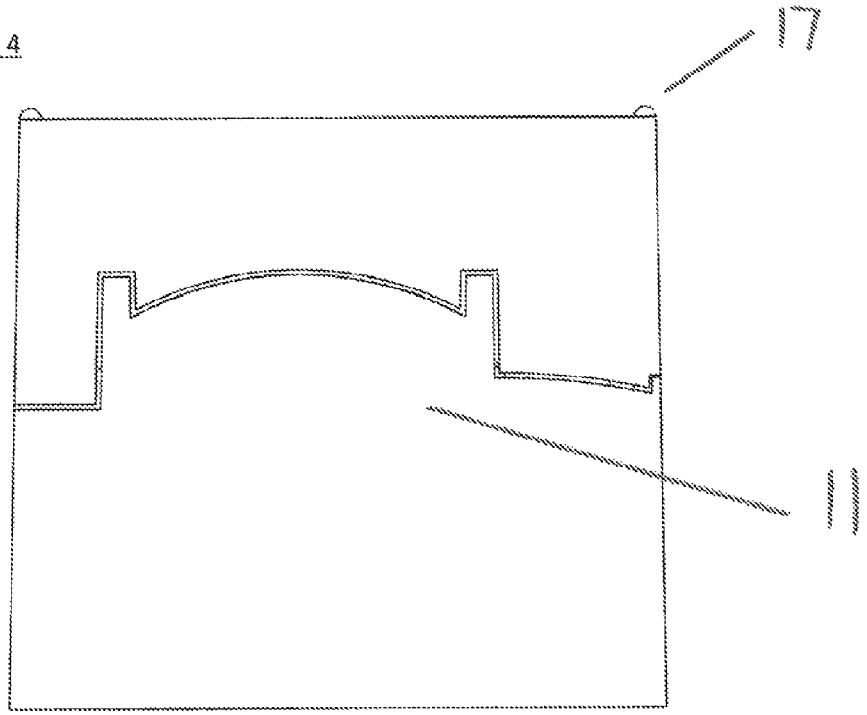
FIGS. 4, 5 and 6 provide front views of respective sides of the invention.
Figure 5:
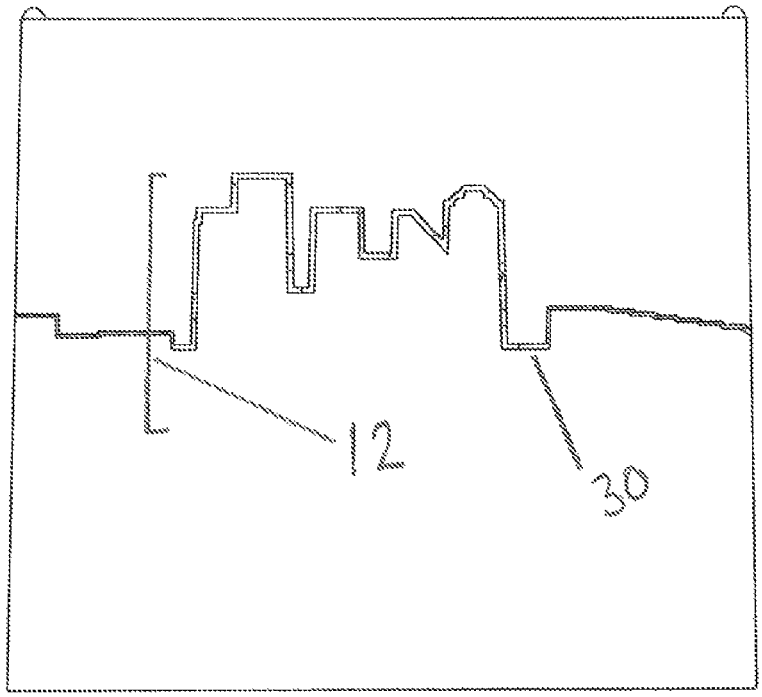

FIGS. 3 and 4 each show one side 14, 11 respectively, of the geo-cube 10. The portion of the cut 30 upon side 11 shows the shape of the Sydney Harbour Bridge, FIG. 3 showing primarily the harbour itself. FIG. 5 shows side 12 upon which can be seen a portion of the cut 30 configured into a two dimensional silhouette image of the Sydney cityscape skyline.

Figure 6:
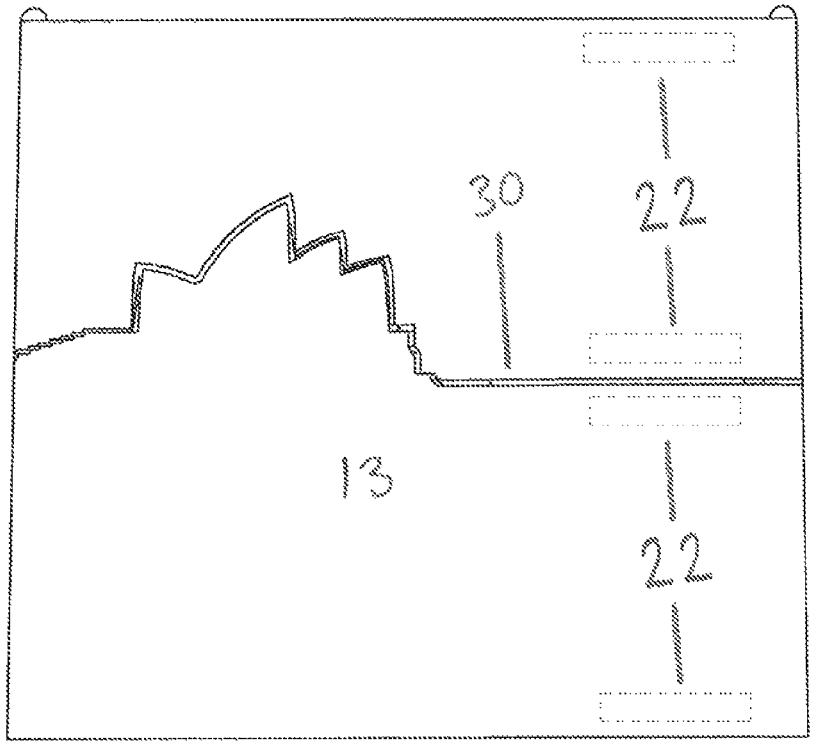

FIG. 6 shows the two dimensional silhouette image of the Sydney Opera House on side 13. It can be seen therefore that it is possible to portray easily recognisable images of various memory evokable elements, such as an iconic geographical location, building, set of buildings, event, or person on at least one side of the geo-cube or upon all sides such that one or more of the external surfaces of the geo-cube may act as a memento or device for the recall in the user or viewer of memories and feelings associated with the particular memory evokable element, such as a particular iconic geographical location, building, set of buildings, event, or person, the viewer being provoked to recall or remember the element when viewing the adjacent sides 11, 12, 13, 14 of the geo-cube. In other embodiments of the invention, sides 15 and 16 may also incorporate recognisable silhouettes provided by cuts which are reminiscent of iconic geographical locations, buildings, events or persons.

In an especially preferred embodiment, as shown in FIGS. 1, 3 and 4, covering portion 20 has a plurality of protrusions 17 located upon its external surface 15. The protrusions allow for the stacking of the display portion upon the covering portion.

Figure 7:
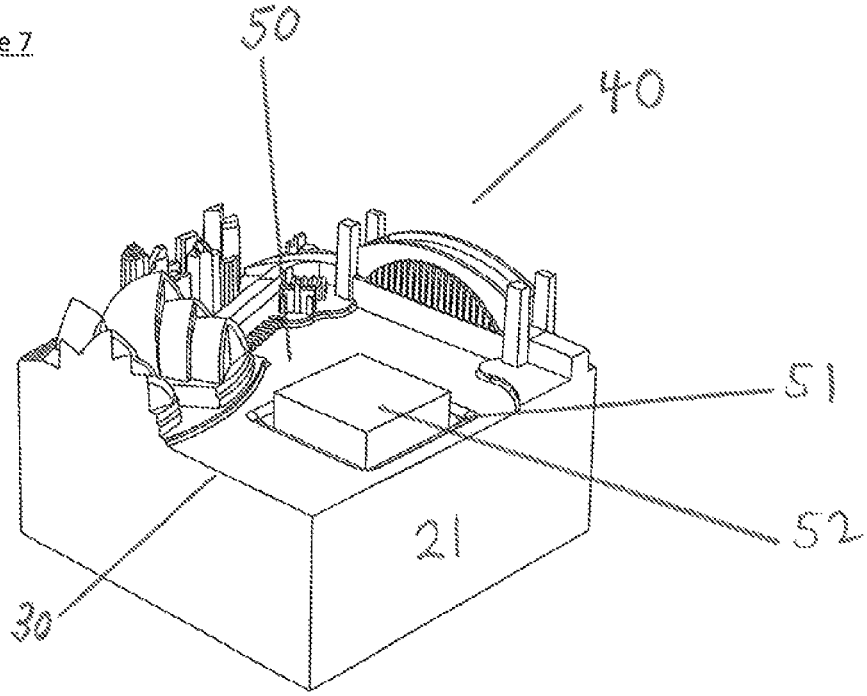
FIG. 7 is an isometric view of the base portion showing the displayed three dimensional profile.
Figure 8:
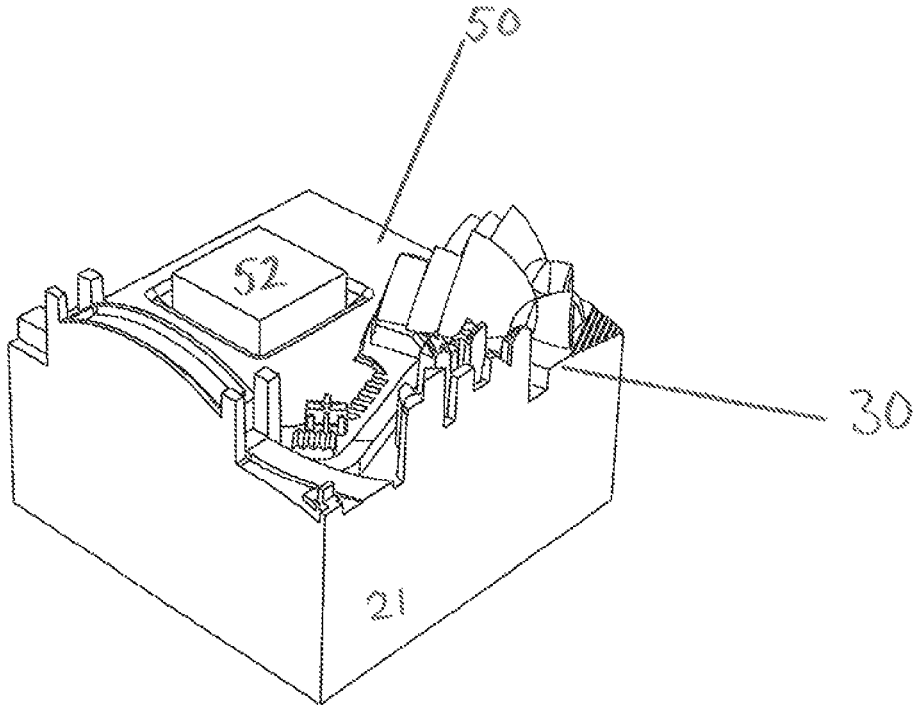
FIG. 8 is a further aspect of the display portion.
Figure 9:
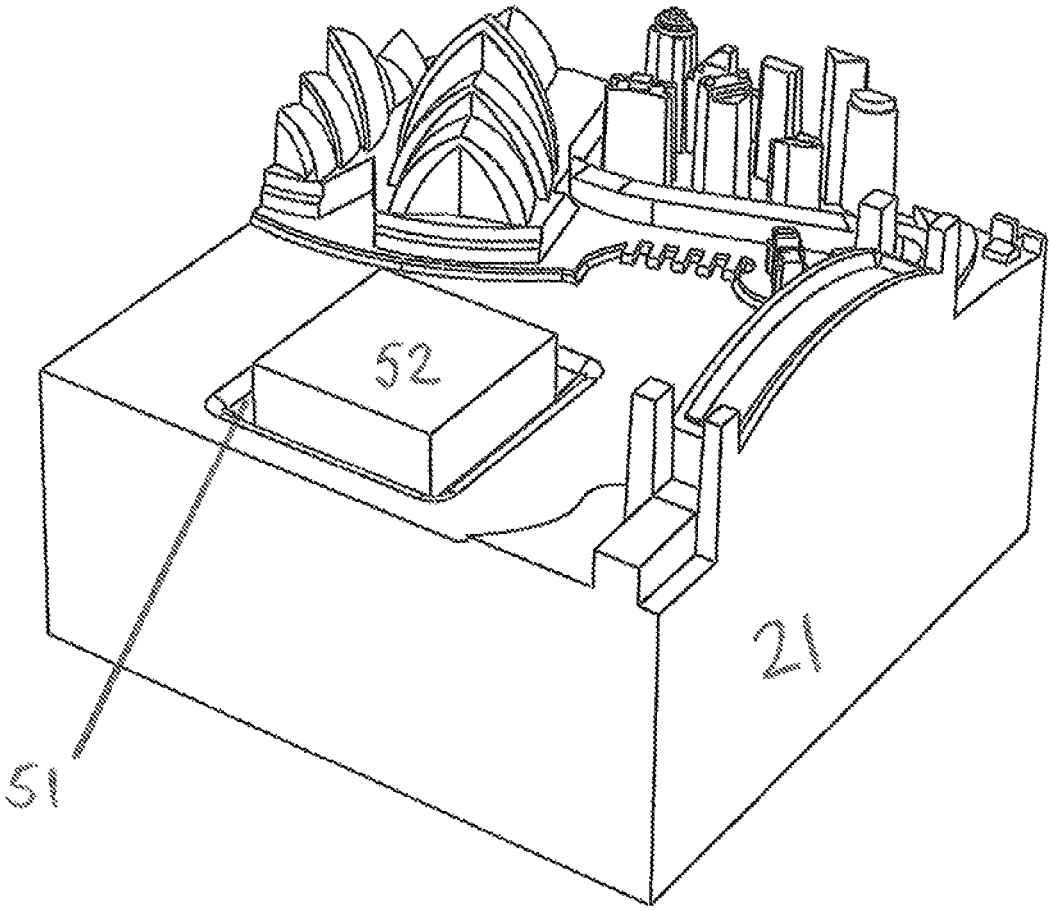
FIG. 9 is another aspect of the display portion.
Figure 10:
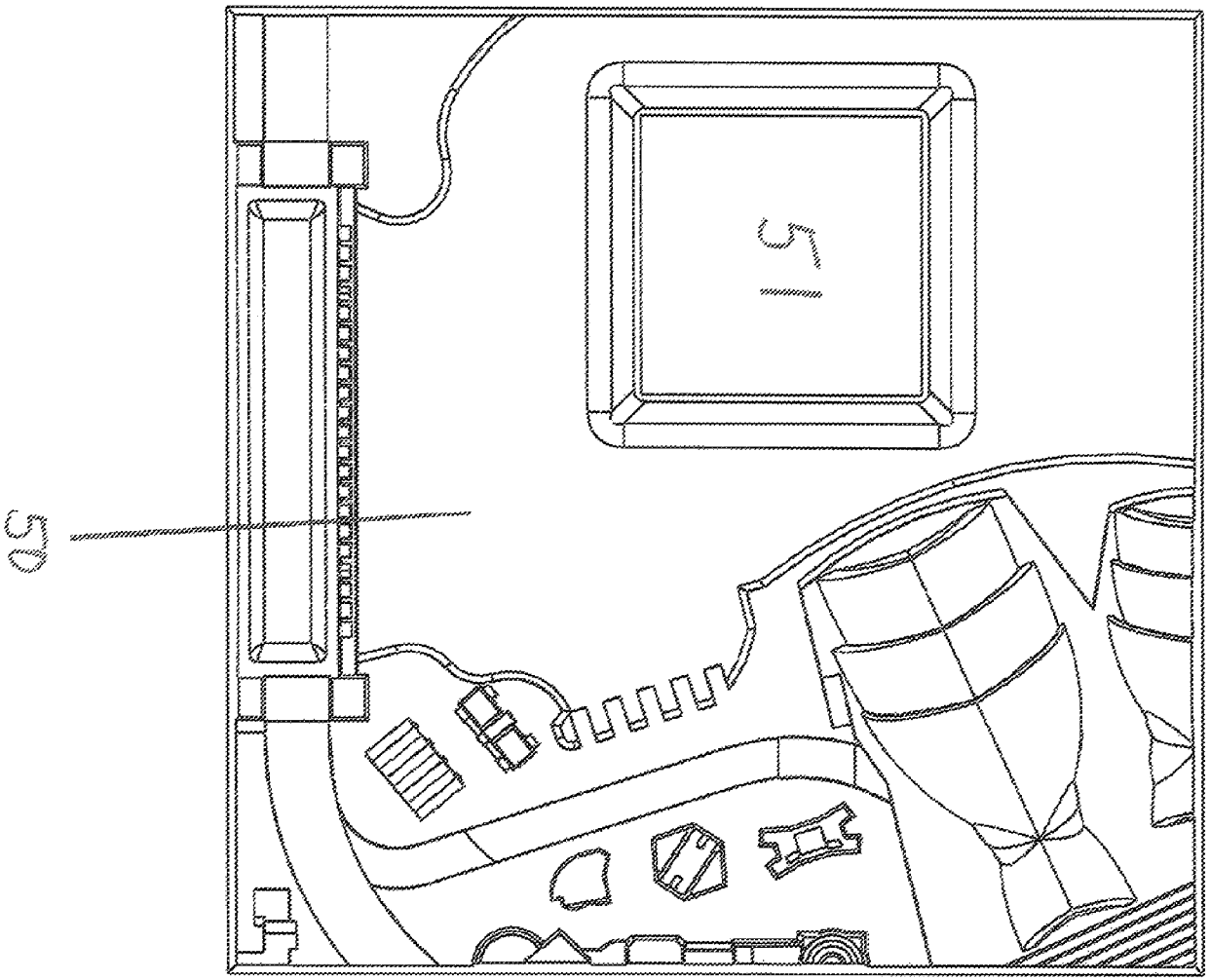
FIG. 10 is a plan view of the displayed three dimensional profile located upon the display portion.
Figure 11:
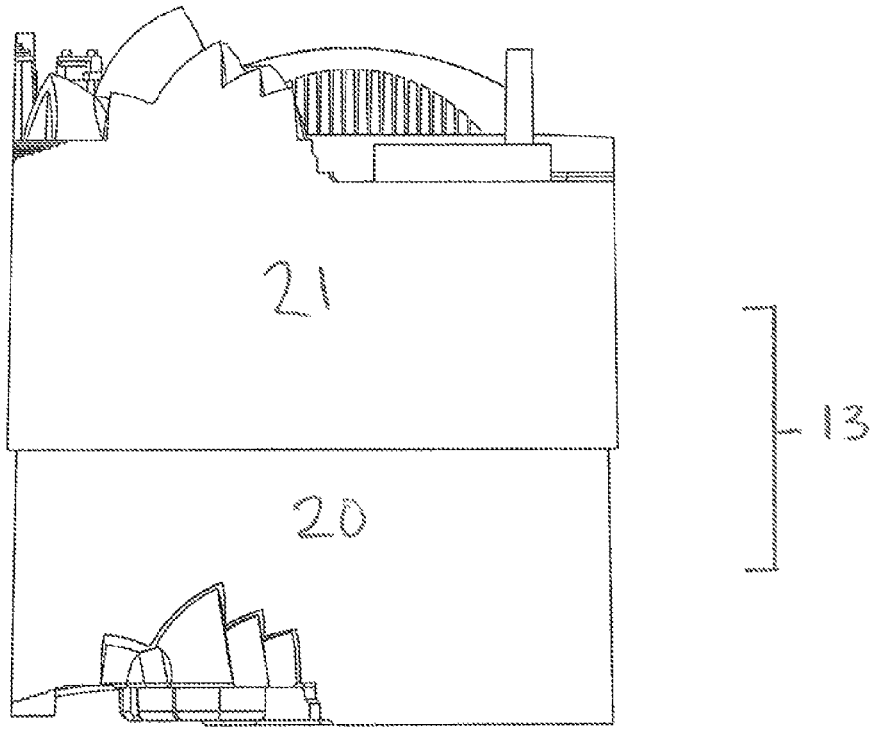
FIG. 11 is a side view of the display portion stacked upon the covering portion.
Figure 12:
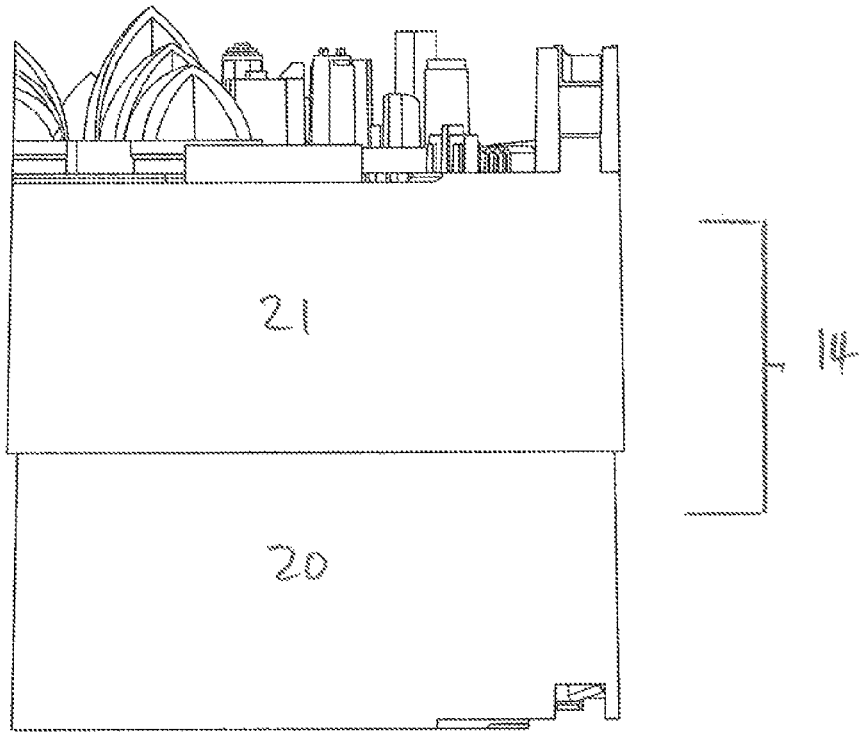
FIGS. 12, 13 and 14 are additional views of the display portion stacked upon the covering portion.
Figure 13:
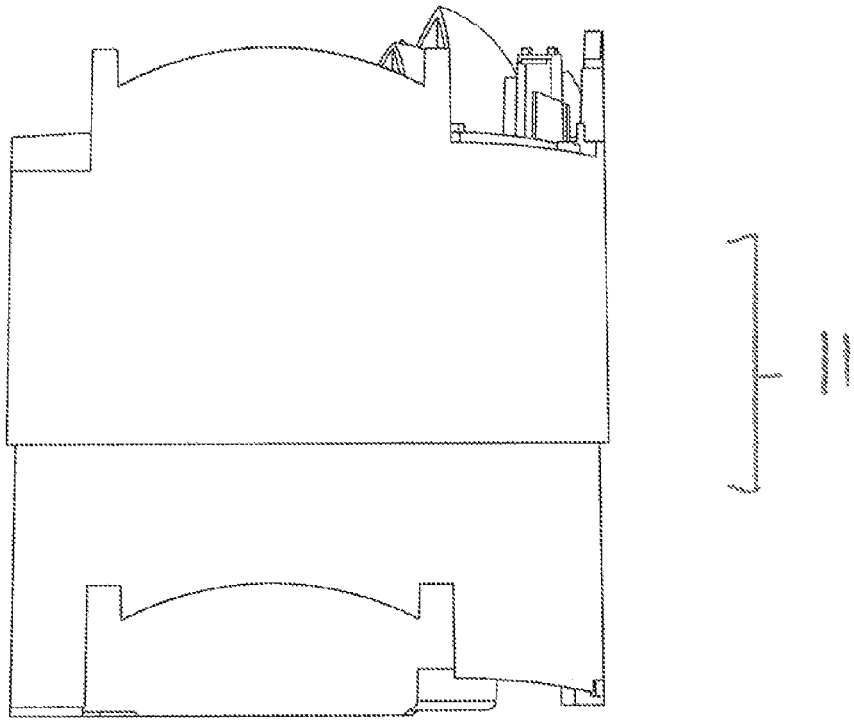
Figure 14:
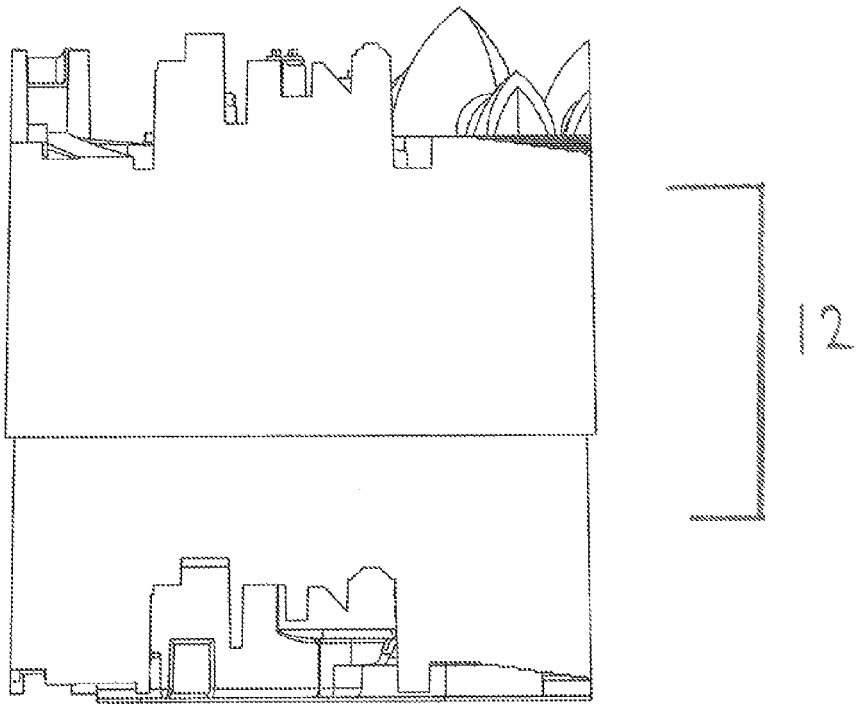

With reference to FIG. 7, the display portion 21 has a display surface 50 upon which is situated a three dimensional representation or display profile 40 of the memory evokable element, in this case specifically being Sydney Harbour and the associated iconic buildings and structures. Display surface 50 of the display portion 21, in effect, provides a scale model of the iconic location, including specific buildings, geographic features, and structures, such as the harbour bridge, illustrating the subject matter to be recalled or remembered by the user. As can been seen in FIGS. 7, 8, 9 and 10, the display profile 40 provided in this embodiment comprises the buildings and landmarks of Sydney Harbour and foreshore from which can be readily recognised the Harbour Bridge, the Opera House and the city skyline amongst other landmarks in fine detail.

The surface 50 of the display portion additionally has a recess 51 located within it for retaining a relic 52 which is an item taken from or closely associated with the memory evokable element, such as the geographical location, cityscape, building, event or person represented on the display portion 40. Relics may comprise any of a number of items associated with the memory evokable element, such as but not limited to a fragment of a building, flagstone, a precious metal or stone from the geographical region, fragments of an historical object, a wine bottle, glass, bone, tooth or other any other such item closely associated with the memory evokable element, and so the choice of relic will depend upon the preferences of the user.

In alternative embodiments, the display portion may be hollow such that it may be filled with liquid such as water or spirituous liquors representative of the region depicted on the display surface 50 of the display portion 40. In such embodiments, the liquid can be a substitute for the relic, and the relic 52 may be replaced with a bung or sealing mechanism for securely retaining the liquids or other substances.

In some preferred embodiments of the invention, the covering portion 20 can have a plurality of protrusions 17 located upon an external surface to allow for the stacking of the complementary portions 20, 21 one upon the other for the viewing of the display 40 and/or relic, the covering portion then acting as a base to give more prominence to the display portion with the three dimensional profile as well as to the incorporated relic.

In some embodiments of the invention, the protrusions of the covering portion 20 may be secured within a plurality of complementary depressions (not shown) located upon a bottom surface or side 16 of the display portion 21 so as to limit the independent movement of the portions 20, 21 when stacked. Other means to more firmly engage the two portions may also be used. For example, releasable fasteners, such as magnets 22 shown in broken lines in FIG. 6 or other interlocking structures, may be incorporated into the upper and/or lower portions to allow for the ease in removably linking the portions together, either in the protected transport mode, when the covering portion resides on the three dimensional profile, or the display mode when the covering portion acts as a base. Such releasable fasteners may also be used not only for the display and covering portions of one souvenir, but also possibly to removably link other adjacent souvenirs when multiple souvenirs are arranged to as to present a larger overall display of the profiles and associated relics.

In other embodiments of the invention, the protrusions 17 and depressions are located upon the display and covering portions 20, 21 so that when engaged, the stacked portions appear to be a single, integrally formed unit as is shown in FIGS. 11, 12, 13, and 14.

When stacked, the portions of cut 30 visible on each side 11, 12, 13 and 14 can be seen in both positive and negative aspect which is both interesting and pleasing to the eye of the user or viewer. This enhances the recollection of the user by doubling the visual information available from the portions of the cut 30 shown in profile on the sides of the geo-cube 10.

A memento or souvenir is an article used to facilitate a memory or recollection by the user of a memory evokable element, such as a visit to a particular location, geographic region, iconic piece of architecture, event or occasion, or to recall features of a particular person or group of people. The use of a piece or fragment of an iconic architectural structure, geographical feature, an historic item, or similar relic from a particular locale placed within a three dimensional profile to accentuate or enhance the memory of the user/traveller is hitherto unknown in the prior art.

The incorporation of a relic 52 into the display surface 50 of the display portion 40 promotes the more efficacious stimulation of memory in the user using the souvenir by reason of the combination of a specific three dimensional profile moulded in a "plastic" medium with a relic 52 along with other stimulus drawn from that location, namely the aspect of the memory evokable element depicted on each side of the souvenir formed by the mating edges forming cut 30 which can be recognised from a number of perspectives or viewpoints (sides 11, 12, 13, 14). The combination of viewed silhouettes in portions 20 and 21 in double when the portions are stacked further enhances the facilitation of recollection, memory and reminiscence achieved by the souvenir.

The complementary topographical aspect of the three dimensional profiled display and the negative or female aspect of the display in the covering portion means that the geo-cube can be safely transported without the risk of separation or damage as the respective portions interlock interiorly, so the profile surfaces and structures are protected and only exposed when the covering portion is removed to facilitate display. In that way, structures depicted, such as a church tower for example, will not be damaged during transport.

Because the souvenir of the preferred embodiment is stackable, it is possible to display a plurality of souvenirs collected over the course of a lifetime simultaneously whilst retaining the aesthetic integrity of each discreet souvenir. Each portion of the cut 30 on each external side of a souvenir relating to a particular memory evokable element, whether an iconic location, landmark, building, event, structure or person is unique and so it is possible to display any number of souvenirs in any number of configurations such as, for example, a column, row, cube, or any other configuration as desired by the user. This feature of stackability and alignability also enables the manufacturer to produce, and other users to purchase, a collection of souvenirs from a lifetime of travel and experience, and to arrange them to present a personalized display.

In a preferred embodiment, the mating display and covering surfaces are precise positive or negative aspect of the other. This means that the positive and negative surfaces are fairly precisely matched so that one portion can be used for example to cast a mating portion, should one portion be lost or damaged. For example, in the case that one of the portions 20 or 21 is lost or damaged, a replacement can be easily manufactured using the remaining portion as the portions are complementary.

It should be understood that the souvenir of the present invention may be manufactured from all types of materials including inexpensive materials such as plastics or expensive materials such as precious metals. The ability to use any number of materials to manufacture the souvenir means that production costs can be kept at a level that is affordable to the economic circumstances and resources of the user. A souvenir manufactured out of precious metals however is likely to function more effectively as a mechanism by which a location, building, event or person might be recalled or remembered as the user will attribute greater value to the souvenir not merely because of the expense associated with acquiring the souvenir but also because generally objects made of more precious materials are more aesthetically pleasing and attractive than those manufactured cheaply. Consequently, the term "souvenir" as used in the application includes not only the mass-produced low cost items typically associated with the term "souvenir", but also items rising to the level of objects d' art, having the characteristics of sculptures or art works of significant aesthetic and artistic value, as well as economic value when made of precious materials. Consequently, either or both of the display portion and covering portion may be composed of a material selected from the group consisting of glass, crystal, plastic, ceramics, metal, precious metal, and combinations thereof.

Alternative configurations of the above are possible according to the user's requirements.

Those skilled in the art will appreciate that there are a variety of applications for which the present device is well suited.

Those skilled in the art will also appreciate that the method of construction herein described may be adapted according to the user's requirements without departing from the scope of the invention.

What is claimed is:

1. A souvenir comprising:

a display portion comprising a base having an upper surface, the upper surface having a three dimensional profile disposed across an interior portion thereof, the three dimensional profile being a representation or display associated with a memory evokable element which can be selected from, but is not limited to, the group consisting of an iconic geographical location, a cityscape, a building, an event, an occasion, a monument, a sculpture, a person, the profile being a positive or male profile; and, a removable covering portion comprising a base having a lower surface with an interior portion having a complimentary three dimensional negative or female profile of the representation or display disposed on the interior portion of the upper surface, the covering portion adapted to be placed over the display portion, such that substantially the entire lower surface, upper surface and interior portions thereof are in a substantially abutting relationship.

2. The souvenir of claim 1 further comprising a relic taken from or closely associated with the representation or display, a recess provided in the upper surface of the display portion for receiving the relic, the relic being disposed within the recess, the recess permitting display of the relic residing therein with the representation or display.

3. The souvenir of claim 1 wherein an upper surface of the covering portion has a plurality of protrusions upwardly extending therefrom, the covering portion being removable and positionable upon a surface, exposing the three dimensional representation or display located on the upper surface of the display portion, a lower surface of the of the display portion being positionable on top of the covering portion with the protrusions adapted for stacking of the display portion upon the covering portion for displaying the representation or display.

4. The souvenir of claim 3 wherein the plurality of protrusions located upon the upper surface of the covering portion are received within a plurality of complementary depressions located upon a lower surface of the base of the display portion so as to limit independent movement of the portions when stacked.

5. The souvenir of claim 3 wherein the plurality of protrusions located upon the upper surface of the covering portion are secured within a plurality of complementary depressions located upon a lower surface of the base of the display portion such that the two portions form a single unit when stacked.

6. The souvenir of claim 1 wherein the display portion and covering portion together assemble into a geometrical shape.

7. The souvenir of claim 1 wherein the display portion and the covering portion assemble in the shape of a cube.

8. The souvenir of claim 1 wherein the three dimensional profile provided on the upper surface of the display portion and the complimentary negative or female profile provided on the lower surface of the covering portion are precisely matched such that either the display portion or the covering portion can be used to manufacture at least part of either a replacement covering portion or display portion, respectively.

9. The souvenir of claim 1 wherein each of the display portion and the covering portion are composed of a material selected from the group consisting of glass, crystal, plastic, ceramics, metal, precious metal, and combinations thereof.

10. The souvenir of claim 1 further comprising releasable fasteners for securing the display portion and covering portion when mated in a protected transport mode with the covering portion disposed over the three dimensional profile and/or a display mode when the display portion is stacked on the covering portion such that the covering portion acts as a base for the display portion.

11. The souvenir of claim 1 wherein each of the upper surface of the display portion and the lower surface of the covering portion have end edges, at least one pair of mated end edges defining a silhouette of the three dimensional profile, such that when the covering portion is placed over the display portion, the silhouette is visible at the junction therebetween.

12. A method of displaying a representation associated with a memory evokable element which can be selected from, but is not limited to, the group consisting of an iconic geographical location, a cityscape, a building, an event, an occasion, a monument, a sculpture, a person, the method comprising providing a souvenir having a display portion, comprising a base having an upper surface, the upper surface having a three dimensional profile formed across or upon an interior portion thereof, the three dimensional profile being a representation or display associated with a memory evokable element which can be selected from, but is not limited to, the group consisting of an iconic geographical location, a cityscape, a building, an event or occasion, a monument, a sculpture, a person, the profile being a positive or male profile; and, providing a removable covering portion, comprising a base having a lower surface having an interior portion having a complimentary three dimensional negative or female profile of the representation or display on interior portion of the upper surface, the covering portion adapted to be placed over the three dimensional profile of the display portion, such that the lower surface, upper surface and interior portions are in a substantially abutting relationship: and, placing the covering portion over the display portion for forming the souvenir.

13. The method of claim 12 further comprising:

providing a recess within the upper surface of the display portion, the recess adapted to retain a relic taken from or closely associated with the representation or display; and, placing the relic in the recess of the display portion for viewing in association with the representation.

14. The method of claim 12 further comprising:

(i) separating the covering portion from the display portion; and, (ii) stacking the display portion upon the covering portion.

15. The method of claim 12 further comprising shaping the display portion and the covering portion such that, when assembled the display portion and the covering portion have a unitary geometric shape.

16. The method of claim 15 wherein the geometric shape is a cube.

17. The method of claim 12 further comprising, when incorporating the three dimensional profile into the upper surface of the display portion, that the upper surface has at least one edge forming a silhouette of the three dimensional profile, such that when the covering portion is placed over the display portion, the silhouette is visible at the junction thereof.

18. The method of claim 12 further comprising providing releasable fasteners for securing the display portion and covering portion when mated in a protected transport mode with the covering portion disposed over the three dimensional profile and/or a display mode when the display portion is stacked on the covering portion such that the covering portion acts as a base for the display portion.

* * * * *